United States Patent [19]

Rubenstein et al.

[11] 4,146,032

[45] Mar. 27, 1979

[54] EAR PIERCING DEVICE

[76] Inventors: Roger H. Rubenstein, 7514 Via De La Compana, Scottsdale, Ariz. 85258; Lee R. Bridges, 2235 N. 37th St., Phoenix, Ariz. 85018

[21] Appl. No.: 801,413

[22] Filed: May 27, 1977

[51] Int. Cl.[2] ..... A61B 17/00

[52] U.S. Cl. ..... 128/330

[58] Field of Search ..... 128/330, 329 R; 40/301; 63/12

[56] References Cited

U.S. PATENT DOCUMENTS

| | | | |
|---|---|---|---|
| 3,941,134 | 3/1976 | McDonald | 128/330 |
| 3,943,935 | 3/1976 | Cameron | 128/330 |

*Primary Examiner*—Robert W. Michell
*Assistant Examiner*—Michael H. Thaler
*Attorney, Agent, or Firm*—Cahill, Sutton & Thomas

[57] ABSTRACT

In response to actuation of a trigger, a spring loaded shaft drives an ear piercing dart through an earlobe disposed intermediate a pair of positioning guides. The stem of the dart is retained by a clamp, one positionable member of which is attached to one end of a torque rod rotatably mounted within the shaft and the other member is attached to the shaft. Upon rotation of a knob attached to the other end of the torque rod to a detent position, a torque is applied to the torque rod to urge the clamp into securely engaging the stem of the dart. The knob also serves as a means for cocking the shaft. On actuation of the trigger resulting in translatory movement of the shaft and knob and piercing of the earlobe by the dart, means are provided for automatically releasing the knob from the detent position and freeing the dart from the clamp.

18 Claims, 7 Drawing Figures

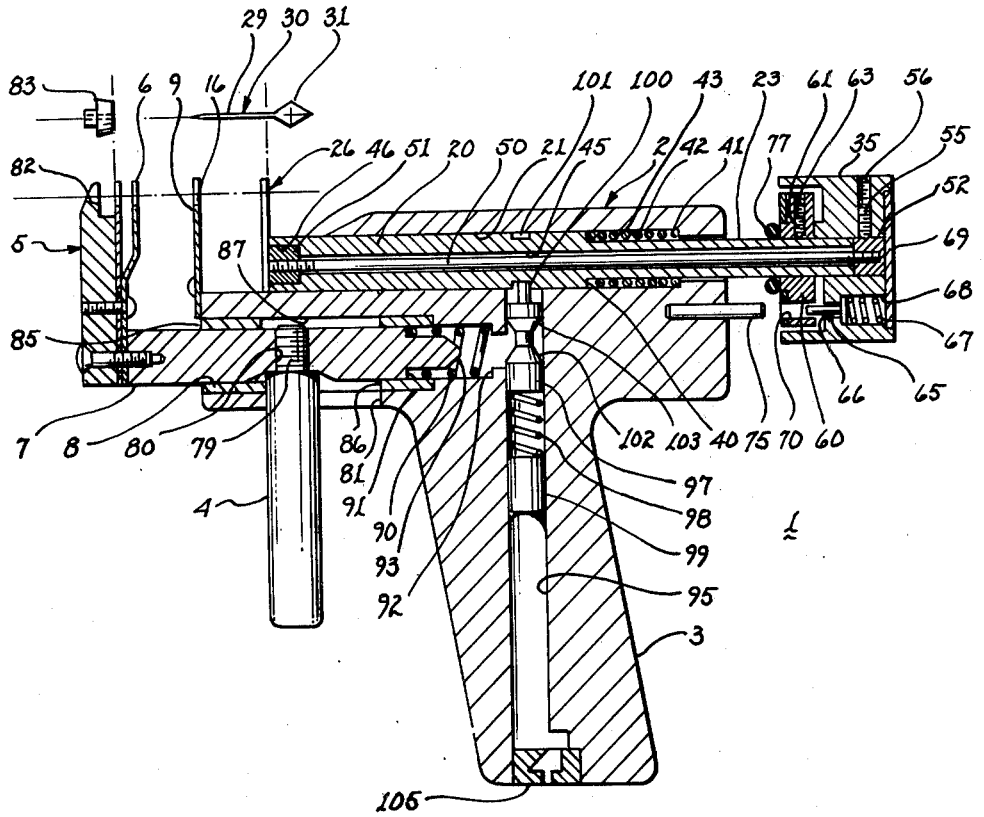

EAR PIERCING DEVICE

The present invention relates to ear piercing devices and, more particularly, to ear piercing devices useable with ear piercing darts having variously shaped heads.

Throughout the years, women and, in some cases men, have pierced their earlobes to receive and support a multitude of ear ornaments. The surgical process of initially piercing the earlobe is often done by self-help methods using a needle. This process is usually painful and in many cases the use of unsterilized needles produces infections. Moreover, the hole formed is invariably mispositioned. In order to overcome many of the basic problems attendant the use of a needle per se as an ear piercing tool, several devices have been developed to promote more accurate positioning and formation of the hole through the earlobe. These implements, as illustrated and described in U.S. Pat. Nos. 229,581, 2,568,207, 2,733,716 and 3,500,829, depend upon manipulation of the implement by an operator to perform the positioning and ear piercing function. Because all but the most skilled operators will necessarily jostle or otherwise cause lateral displacement of the earlobe hole making element, unnecessary pain due to tearing of the skin tissues will occur.

To obviate manual insertion of an earlobe piercing element, various automated implements have been developed. These implements generally incorporate some type of a trigger releasable spring loaded shaft which propels a hole making element through the earlobe. Patents representative of these types of implements include the following: U.S. Pat. Nos. 205,185, 230,073, 248,855, 2,798,491, 3,187,751, 3,941,134, 3,943,935 and 4,009,718. In all of these implements, the spring loaded element, usually a longitudinally translatable shaft, includes a receiver for receiving and retaining the head end of the earlobe hole making element. Necessarily, the receiver must be configured to securely retain the element such that the stem thereof is in alignment with the axis of translation and yet accommodate release of the element from the implement after penetration of the earlobe has been accomplished. Because of these functional parameters, elements having specifically configured heads must be employed with each implement. Such a restriction necessarily delimits or otherwise narrows the available choice of elements by the recipient. Moreover, it precludes the operator from selecting aesthetically attractive elements except as to those from within a group of elements specifically configured to be useable with a particular ear piercing implement or gun.

It is therefore a primary object of the present invention to provide an ear piercing device useable with an ear piercing dart having any type of head.

Another object of the present invention is to provide an ear piercing device which grips only the stem of the ear piercing dart.

Yet another object of the present invention is to provide an ear piercing device having a torque rod actuated clamp for securing the stem of an ear piercing dart.

Still another object of the present invention is to provide an ear piercing device which automatically releases the ear piercing dart upon penetration of the dart through an earlobe.

A further object of the present invention is to provide an ear piercing device having a variety of anvils for accommodating any type of ear piercing dart clip.

A yet further object of the present invention is to provide an ear piercing device with positioning guides brought into operation on actuation of a trigger mechanism.

A still further object of the present invention is to provide an ear piercing device having a manually rotatable and longitudinally translatable knob which actuates a clamp to grip an ear piercing dart and cocks a spring loaded dart propelling shaft.

These and other objects of the present invention will become apparent to those skilled in the art as the description thereof proceeds.

The present invention may be described with greater specificity and clarity with reference to the following drawings, in which.

Figure 1:
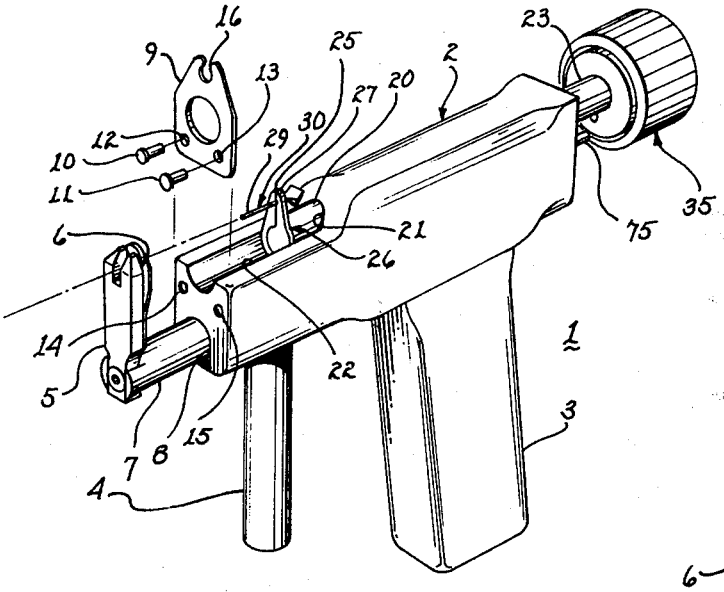
FIG. 1 is a perspective view of an ear piercing device in the cocked position.

FIG. 1 illustrates an ear piercing device, such as ear piercing gun 1, embodying the teachings of the present invention. The gun includes a barrel section 2 and a grip 3. A trigger 4 protrudes from the forward lower extremity of barrel section 2. An anvil 5, including a spring guide 6, extends from trigger shaft 7. The trigger shaft translates longitudinally within a cavity 8 developed within barrel section 2 in response to commensurate movement of trigger 4 with respect to grip 3. Thereby, anvil 5 is spatially positionable with respect to the forward end of the barrel section.

A further guide 9 is secured to the forward end of barrel section 2 by means of screws 10 and 11 penetrating apertures 12 and 13 within the guide and ultimately threadedly engaging threaded apertures 14 and 15 at the forward end of the barrel section. Guide 9 includes a sighting indentation 16 at the upper end thereof, the purpose of which will be described in further detail below.

A shaft 20 is slidably disposed within a barrel 21 and a channel 22, both of which are disposed within barrel section 2. Member 25 of clamp 26 is rigidly secured to the forward end of shaft 20. Member 27 of the clamp is rotatable about the longitudinal axis of shaft 20 and is supported by a torque rod mounted internal to the shaft. In the closed position of clamp 26, as illustrated in FIG. 1, stem 29 of an ear piercing dart 30 is grippingly secured intermediate members 25 and 27. The rear end of shaft 20 supports a knob 35.

Through rearward movement of the knob, resulting in rearward translation of shaft 20, also compresses an internally mounted spring which serves as a spring load for the shaft. Additionally, rotation of knob 35 about the longitudinal axis of the shaft results in rotation of member 27 of clamp 26 to either grip or release the stem of dart 30.

Ear piercing gun 1 is illustrated in FIG. 1 in the cocked configuration. That is, shaft 20 has been drawn back into the cocked position and clamp 26 has been loaded with ear piercing dart 30. Upon actuation of trigger 4, guide 6 and anvil 5 will be brought into proximity with the front surface of guide 9 to gently retain an earlobe to be pierced therebetween. The positioning of the guides with respect to the earlobe is determined by indentation 16, the center of which is reflective of the point at which the earlobe will be pierced. By forming guide 6 of resilient material and mounting the guide (as illustrated) so as to allow limited flexing thereof, the pressure exerted upon the retained earlobe by both guides is readily maintained within an acceptable range of discomfort.

Figure 2:
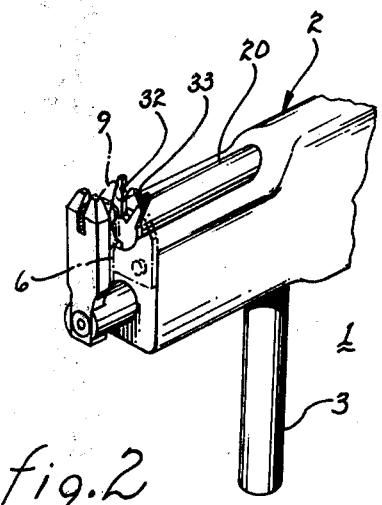
FIG. 2 is a perspective view of the front end of the ear piercing device in the uncocked position.
Figure 3:
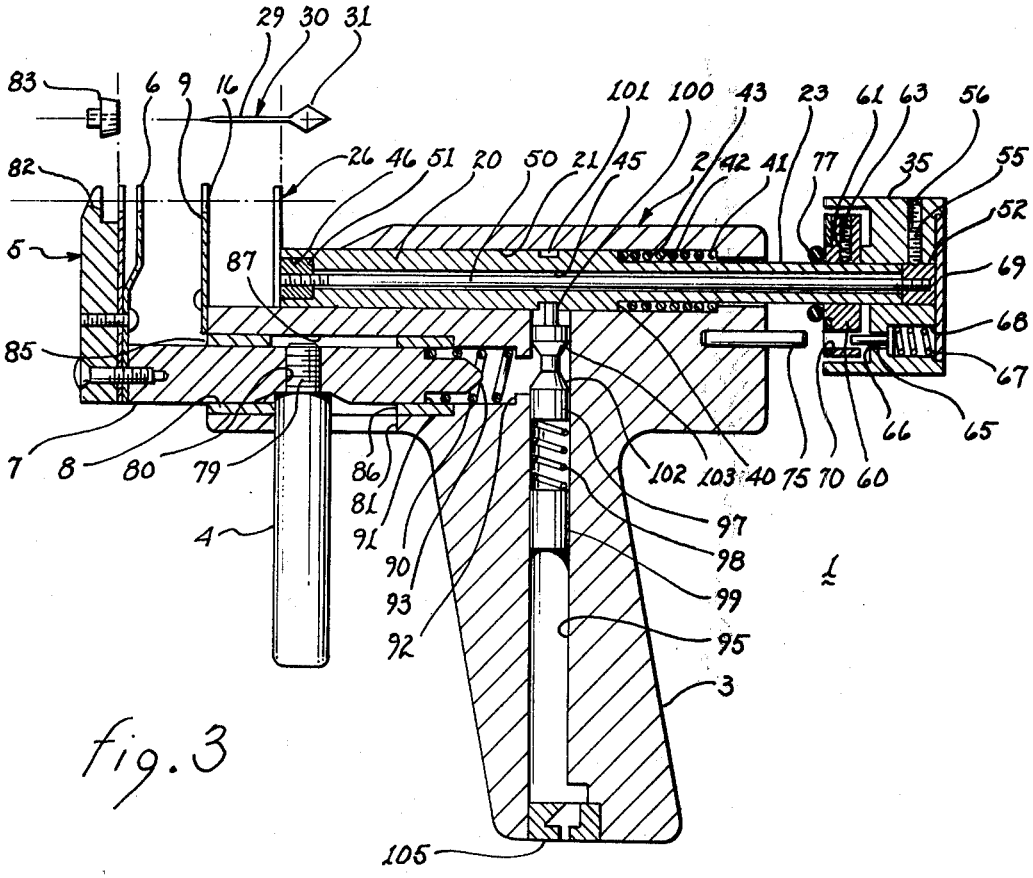
FIG. 3 is a cross-sectional view of the ear piercing device in the cocked position.

In the configuration of ear piercing gun 1 illustrated in FIG. 2, trigger 4 has been actuated to release shaft 20 from its cocked position and permit translation of the shaft toward the forward end of barrel section 2 in response to the force of the internally mounted spring. During the forward movement of shaft 20, clamp 26, supporting the ear piercing dart, is also translated forwardly to force the point of the dart stem to penetrate the earlobe disposed intermediate guides 6 and 9 (which guides are shown in phantom for purposes of clarity). When shaft 20 approaches its forwardmost position, a dowel 75, interacting with knob 35 (see FIGS. 1 and 4) will release the pretwisted torque rod supporting member 27 of clamp 26 and allow the clamp to open, as illustrated in FIG. 2. On opening of the clamp, the ear piercing dart is automatically released and ear piercing gun 1 can be withdrawn to disengage the pierced earlobe from intermediate guides 6 and 9.

Referring jointly to FIGS. 3, 4, 5 and 6, various internal constructional details of the ear piercing gun will be described. Shaft 20 is slidably mounted within barrel 21 to permit translation of the shaft along its longitudinal axis. Although not illustrated, bushings and/or bearings may be employed to minimize friction. Rear section 23 of shaft 20 is necked down at annular shoulder 40. Barrel 21 is necked down at shoulder 41 to a dimension commensurate with that of rear section 23; shoulder 41 is disposed rearwardly of shoulder 40 whereby an annular cavity 42 is developed therebetween. A coil spring 43 is disposed within the annular cavity to provide a bias force to urge shaft 20 toward the forward end of barrel section 2.

Shaft 20 has a hollow core 45 for receiving torque rod 50. The core has an annularly enlarged section 46 at the forward end to receive a bushing 51 non-rotatably attached to one end of the torque rod. The bushing, in turn, is rigidly affixed to member 27 of clamp 26. A further bushing 52 is disposed in rotatable engagement with the other end of shaft 20 and is affixed to the corresponding end of torque rod 50. Bushing 52 is non-rotatably secured to knob 35 by means of a set screw 55 in threaded engagement with threaded cavity 56. Thereby, any rotation of knob 35 about the longitudinal axis of shaft 20 will produce a commensurate twisting of torque rod 50. Moreover, any rearward movement of knob 35 will result in commensurate rearward movement of shaft 20 due to the interconnection between bushing 51 and section 46 of the shaft.

An apertured disc 60 is positioned about shaft 20 interior to knob 35. A set screw 61 in threaded engagement with a threaded radially extending cavity 63 secures the disc to the shaft. A latching pin 65 within knob 35 extends forwardly through cavity 66 and is urged in the forward direction by a coil spring 67 disposed within a chamber 68. A plate 69 is attached to the rear face of knob 35 to seal chamber 68 and retain the spring therein and to cover up, for aesthetic purposes, bushing 52.

The normal position of knob 35 when no torque has been applied to torque rod 50 positions latching pin 66 at bottom dead center. This position also corresponds to the open position of clamp 26 (see FIG. 2). By turning knob 35 in the clockwise direction (viewed from the rear), a torque will be applied to torque rod 50 resulting in repositioning of member 27 into abutting engagement with member 25 to grasp the stem of a dart disposed therebetween. To maintain this position, disc 60 includes an aperture 70 radially displaced from bottom dead center by an angle sufficient to bring members 25 and 27 into abutting engagement with one another and also twist torque rod 50 sufficiently to create a force biasing the members toward one another. On turning knob 35 sufficiently to bring latching pin 65 into alignment with aperture 70 in disc 60, the force of spring 67 acting upon the latching pin will force the latching pin into engagement with the aperture. Such engagement will inherently positionally lock knob 35 to preclude further rotation thereof with respect to shaft 20. Thereby, torque rod 50 has been twisted sufficiently to close clamp 26 and establish a bias force tending to maintain the clamp in the closed configuration. It is to be understood that the latching pin may be positioned at other than bottom dead center with aperture 70 being radially commensurately relocated.

A dowel 75 extends rearwardly from the rear face of barrel section 2 and is positioned so as to be in alignment with aperture 70 in disc 60. When knob 35 is proximate the rear face of barrel section 2, dowel 75 penetrates aperture 70 and forces disengagement of latching pin 66 with the aperture. Such disengagement removes the rotational restraining force imposed upon the knob and, under influence of the torque existing within torque rod 50, the knob will rotate counterclockwise and result in the opening of clamp 26 to release the formerly clamped ear piercing dart. A rubber O-ring 77 or similar shock absorbing element may be disposed intermediate disc 60 and the rear face of barrel section 2 to soften the shock of the knob impacting the barrel section on actuation of trigger 4.

Trigger 4 includes a threaded stud 79 threadedly engaged with cavity 80 within trigger shaft 7 and the trigger extends from within the barrel section through a slot 81 of a length commensurate with the necessary trigger movement. The forward end of trigger shaft 7 may have attached thereto an anvil 5 having an upper receptacle 82 for receiving a particularly configured clip 83, which clip engages the point of stem 29 of dart 30 driven through the earlobe. In the alternative, anvil 5 may include no receptacle in the event no clip is to be used or in the event a manually attached cip is to be used. Bushings 85 and 86 support trigger shaft 7 within a cavity 87 in the forward part of barrel section 2. A coil spring 90, positioned intermediate annular shoulder 91 of the trigger shaft and annular shoulder 92 of cavity 87 provides a bias force tending to urge the trigger shaft in the forward direction.

Cavity 87 is in communication with a cavity 95 extending through grip 3 to barrel 21. A spool 97 is slidably disposed within cavity 95 and is biased toward barrel 21 by means of a coil spring 98 bearing against a plug 99. A prong 100 extends from the upper end of the spool for engagement with an annular groove 101 encircling shaft 20. Sides 102 and 103 of the spool are cone shaped. The lower end of cavity 95 may include a point sharpener 105 for sharpening the tip of an ear piercing dart prior to insertion of the dart through an earlobe. The chamber defined by plug 99 and sharpener 105 serves as a depository for shavings. Tip 93 of trigger shaft 7 is pointed and set at an angle commensurate with that of side 102 of spool 97 such that on engagement of the tip with the side, downward movement of the spool along its longitudinal axis will result. On removal of tip 93 from contact with spool 97, the force of spring 98 will urge the spool upwardly until prong 100 bears against the surface of shaft 20.

In operation, knob 35 is pulled rearwardly until prong 100 comes into engagement with annular groove 101 and precludes further longitudinal movement of the shaft in either direction along its longitudinal axis. Ear piercing dart 26 is inserted intermediate members 25 and 27 of clamp 26 (the members may include indentations 32, 33 for grasping the stem of the ear piercing dart). By turning knob 35 until latching pin 67 penetratingly engages aperture 70, a torque is applied to torque rod 50 to close clamp 26 and securely engage the stem of the ear piercing dart therebetween. Ear piercing gun 1 is now ready for use.

Figure 4:
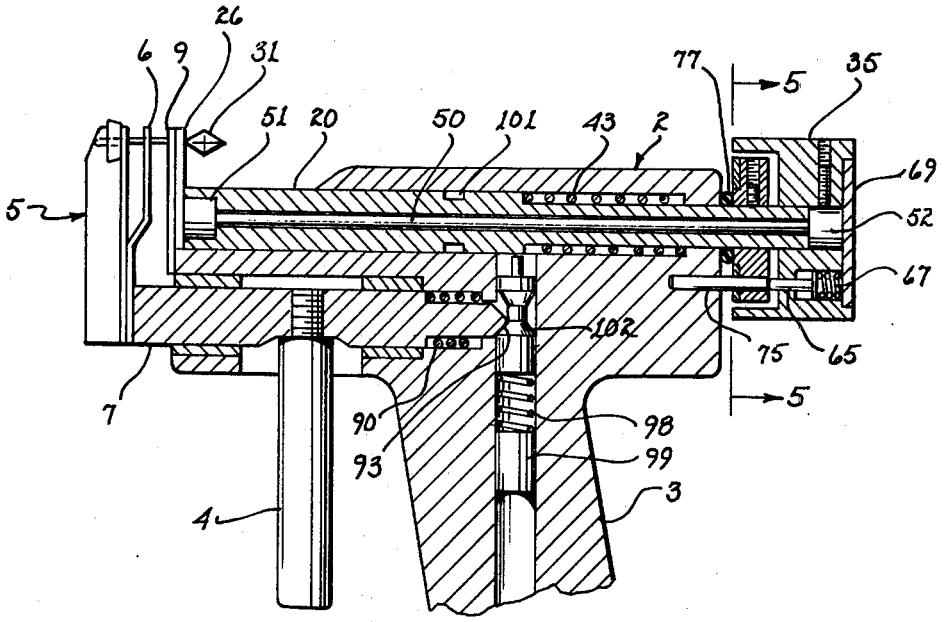
FIG. 4 is a cross-sectional view of the ear piercing device in the uncocked position.
Figure 5:
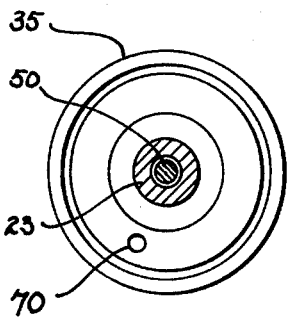
FIG. 5 is an end view taken along lines 5—5.
Figure 6:
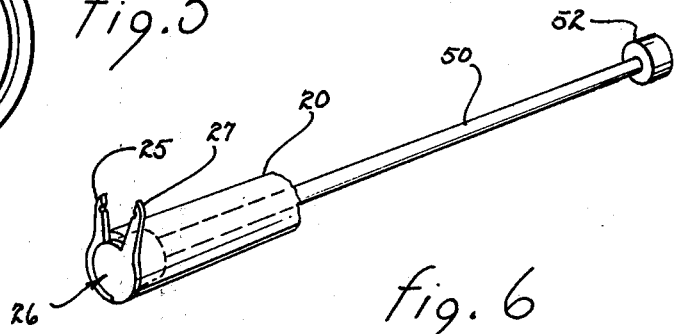
FIG. 6 is a partial view of the torque rod assembly.

An earlobe to be pierced is positioned intermediate guides 6 and 9 and positionally keyed by means of indentation 16. Through partial actuation of trigger 4, that is, drawing the trigger toward grip 3, guide 6 is brought toward guide 9 and gently retains the earlobe therebetween. As pointed out above, guide 6 is resilient and positionally displaced from anvil 5 so as to preclude painful retention of the earlobe. Further actuation of trigger 4 results in point 93 of the trigger shaft bearing against side 102 of spool 97 to force the spool to move downwardly. Downward movement of the spool results in disengagement of prong 100 with annular groove 101 and, upon such disengagement, the shaft becomes free to move forwardly under urging of spring 43. The resulting forward movement of shaft 20 drives the clamped ear piercing dart through the earlobe at the predetermined spot. Additionally, the point of the stem of the ear piercing dart engages clip 83, if the latter is employed, which clip precludes inadvertent withdrawal of the ear piercing dart from the earlobe. Simultaneously, knob 35 is repositioned adjacent the rear face of barrel section 2, as illustrated in FIG. 4. In this position of knob 35, dowel 75 penetrates aperture 70 within disc 60 and forces the latcing pin out of the aperture. Upon release of the latching pin, knob 35 and member 27 of clamp 26 are free to turn under the influence of torque rod 50 whereby the ear piercing dart is released from the clamp. Since the earlobe clamping force of guides 6 and 9 is relatively gentle, the ear piercing gun can be pulled away from the earlobe without releasing trigger 4 and leave the dart imbedded within the pierced earlobe. Alternatively, a partial or complete release of trigger 4 will result in forward movement of trigger shaft 7 due to the bias force provided by spring 90. Such forward movement of the trigger shaft will displace guides 6 and 9 apart from one another and remove retaining force exerted thereby against the earlobe.

Figure 7:
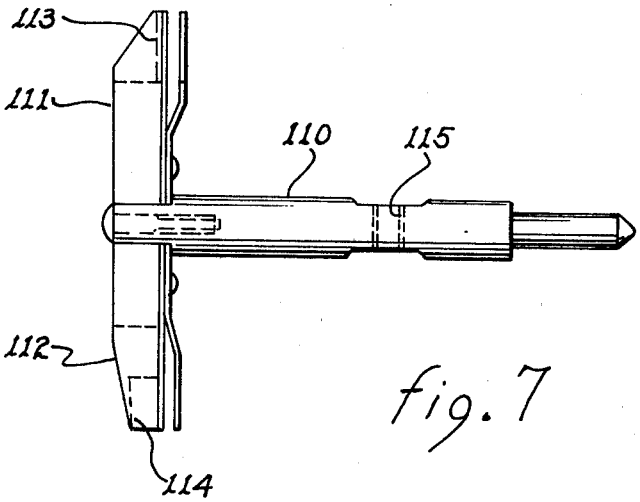
FIG. 7 illustrates a replacement anvil for the ear piercing device.

Referring to FIG. 7, there is shown an alternate embodiment of the above discussed trigger shaft. Herein, a trigger shaft 110 having a pair of anvils 111 and 112 is shown. Each of these anvils is identical to anvil 5 except that receptacles 113 and 114 at the extremities of anvils 111 and 112 are configured to receive different types of clips for use with a predetermined ear piercing dart. A threaded cavity 115 extends diametrically through trigger shaft 110 such that trigger 4 may be threaded into either end of the cavity.

To replace an existing anvil and trigger shaft with a dual anviled trigger shaft, such as illustrated in FIG. 7, trigger 4 is threadedly disengaged and the existing trigger shaft is withdrawn from within cavity 87. The dual anviled trigger shaft is then inserted within cavity 87 and supported upon bushings 85 and 86. The dual anvil trigger shaft is oriented such that the receptacle to be used is in general alignment with existing guide 9. Thereafter, trigger 4 is inserted through slot 81 of the barrel section and brought into threaded engagement with threaded cavity 115. Subsequently, the other anvil may be readily brought into use by simply unscrewing trigger 4, rotating trigger shaft 180° and rethreading trigger 4 into threaded cavity 115.

From the above description, it will become apparent that any type of ear piercing dart 26 may be employed provided only that it have a stem grippable intermediate members 25 and 27 of clamp 26. That is, the selection of the ear piercing dart to be used can be based solely upon the aesthetic and ornamental appeal of head 31 of the dart and without consideration of the material employed for the stem. Thereby, the recipient is not limited to a selection to one of a limited number of "training" darts as is presently true for all ear piercing implements which engage the head of a dart. Moreover, since it is the sum of the dart which is clamped, the head may be grasped to load the ear piercing gun with an ear piercing dart. This capability eliminates the need to touch or otherwise desterilize the normally sterilized stems of the darts resulting in less probability of infection of the pierced earlobe.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. An ear piercing gun for inserting ear piercing darts into an earlobe, said gun including a barrel section, a grip and a trigger, said gun comprising in combination:

a. longitudinally translatable means disposed in the barrel section for translating the dart in a first direction from a first position to a second position to effect piercing of the earlobe;

b. means for biasing said translating means in the first direction;

c. means for drawing said translating means in a second direction from the second position to the first position to cock said gun;

d. torque actuated means for gripping the stem of the dart, said gripping means being disposed in proximity to one end of said translating means;

e. means for latching said gripping means to maintain the torque of said gripping means;

f. means for releasing said latching means on translation of said translating means from said first position to said second position; and g. means actuated by the trigger for uncocking said gun to permit translation of said translating means from the first position to the second position in response to said biasing means;

whereby, the dart is driven in the first direction to pierce the earlobe on actuation of said uncocking means while being securely clamped by said gripping means and is released from said gripping means on positioning of said translating means at the second position.

2. The gun as set forth in claim 1 wherein said translating means comprises a shaft slidably within the barrel section.

3. The gun as set forth in claim 2 wherein said gripping means comprises:

a. a torque rod concentric with said shaft;

b. a first clamp member secured to said shaft; and c. a second clamp member secured to said torque rod.

4. The gun as set forth in claim 3 wherein said drawing means comprises a knob secured to said torque rod.

5. The gun as set forth in claim 4 wherein said latching means comprises:

a. an apertured element secured to said shaft; and b. a latching pin for selectively engaging the aperture of said apertured element on rotation of said knob to apply and maintain a twist to said torque rod.

6. The gun as set forth in claim 5 wherein said releasing means comprises a dowel extending from the barrel section for disengaging said latching pin from the aperture upon positioning of said shaft in the second position.

7. The gun as set forth in claim 6 wherein said shaft includes an axial cavity for receiving said torque rod and an elongated axial cavity in proximity to said gripping means.

8. The gun as set forth in claim 7 wherein said torque rod includes a first bushing disposed within said elongated axial cavity and a second bushing secured to said knob.

9. The gun as set forth in claim 8 including guide means for positioning the earlobe to be pierced with respect to the dart.

10. The gun as set forth in claim 9 wherein said uncocking means comprises:

a. means for locking said shaft in said first position; and b. a trigger shaft translatable in response to movement of the trigger for releasing said shaft from said locking means.

11. The gun as set forth in claim 10 wherein said locking means comprises:

a. a groove disposed within said shaft;

b. a prong disposed within a cavity in the grip for engaging said groove; and c. spring means for urging said prong toward said shaft.

12. The gun as set forth in claim 11 including a spool for supporting said prong, said spool having an inclined side for interaction with said trigger shaft.

13. The gun as set forth in claim 12 further including an anvil extending from said trigger shaft for supporting a clip to engage the stem of the dart on translation of the shaft supported dart from the first position to the second position.

14. The gun as set forth in claim 13 wherein said guide means comprises a first guide secured to the barrel section and a second guide secured to said anvil for retaining the earlobe to be pierced therebetween.

15. The gun as set forth in claim 14 including sharpening means disposed within the grip for sharpening the point of the dart.

16. The gun as set forth in claim 3 wherein each of said first and second clamp members includes an indentation for receiving the stem of the dart.

17. In an ear piercing gun for driving an ear piercing dart into an earlobe, said gun having a barrel section for slidably retaining a spring loaded axially translatable hollow core shaft to drive the dart into the earlobe, means for cocking the shaft, a trigger for releasing the cocked shaft, and guide means for retaining the earlobe to be pierced in positional relationship to the driven dart, the improvement comprising in combination:

a. a torque rod mounted within the core of the shaft;

b. a two member clamp for gripping the stem of the dart and having a first member secured to one end of said shaft and a second member secured to one end of said torque rod;

c. a knob for twisting said torque rod to bias the first and second members of said clamp toward one another and exert a gripping force upon the stem of the dart;

d. releasable latching means disposed intermediate said knob and said shaft for maintaining said torque rod twisted while said shaft is cocked;

e. release means for releasing said latching means on return of said shaft to the uncocked state;

whereby, said torque biased clamp maintains a grip upon the stem of the dart until the dart has been driven into the earlobe.

18. The improvement as set forth in claim 17 including indentations disposed in each of the first and second members for receivingly gripping the stem of the dart.

* * * * *